US010575706B2

(12) United States Patent
Woo et al.

(10) Patent No.: US 10,575,706 B2
(45) Date of Patent: Mar. 3, 2020

(54) DISHWASHER

(71) Applicant: LG ELECTRONICS INC., Seoul (KR)

(72) Inventors: Seyoung Woo, Seoul (KR); Sangheon Yoon, Seoul (KR); Joonho Pyo, Seoul (KR)

(73) Assignee: LG Electronics Inc., Seoul (KR)

( * ) Notice: Subject to any disclaimer, the term of this patent is extended or adjusted under 35 U.S.C. 154(b) by 270 days.

(21) Appl. No.: 15/662,892

(22) Filed: Jul. 28, 2017

(65) Prior Publication Data

US 2018/0042446 A1 Feb. 15, 2018

(30) Foreign Application Priority Data

Aug. 12, 2016 (KR) ..... 10-2016-0103291

(51) Int. Cl.

| | |
|---|---|
| ***A47L 15/22*** | (2006.01) |
| ***A47L 15/20*** | (2006.01) |
| ***A47L 15/42*** | (2006.01) |
| ***A47L 15/23*** | (2006.01) |
| ***A47L 15/00*** | (2006.01) |

(52) U.S. Cl.

CPC ..... *A47L 15/22* (2013.01); *A47L 15/0018* (2013.01); *A47L 15/20* (2013.01); *A47L 15/428* (2013.01); *A47L 15/4282* (2013.01); *A47L 15/23* (2013.01)

(58) Field of Classification Search

CPC ..... A47L 15/20; A47L 15/22; A47L 15/23; A47L 15/428; A47L 15/4282

See application file for complete search history.

(56) References Cited

U.S. PATENT DOCUMENTS

| | | | |
|---|---|---|---|
| 5,415,350 | A | 5/1995 | Yoon et al. |
| 2011/0146734 | A1 | 6/2011 | Rappette |
| 2016/0220092 | A1 | 8/2016 | Seyoung et al. |

FOREIGN PATENT DOCUMENTS

| | | | |
|---|---|---|---|
| JP | 2782943 | | 6/1992 |
| JP | 2014121353 | | 7/2014 |
| KR | 10/2012/0134370 | | 12/2012 |
| KR | 20120134370 A | * | 12/2012 |
| KR | 10-2014-0032761 | | 3/2014 |
| KR | 10-2016-0094753 | | 8/2016 |

OTHER PUBLICATIONS

Extended European Search Report in European Application No. 17179319.3, dated Jan. 15, 2018, 10 pages.

* cited by examiner

*Primary Examiner* — Spencer E Bell
(74) *Attorney, Agent, or Firm* — Fish & Richardson P.C.

(57) ABSTRACT

A dishwasher that includes: a tub; a main arm configured to rotate about a first axis and spray water; an auxiliary arm configured to rotate about a second axis and spray water in the interior space; a stationary gear unit configured to rotate based on rotation of the main arm to generate rotational force and including a plurality of gear teeth; an eccentric rotation unit engaged with one or more teeth of the plurality of gear teeth, and configured to, (i) based on rotation of the main arm, rotate to transfer rotational force of the stationary gear unit to the auxiliary arm and, (ii) based on resistance force from the auxiliary arm, control transfer of rotational force of the stationary gear unit to the auxiliary arm; and a link member configured to rotate the auxiliary arm based on rotational force of the stationary gear unit is disclosed.

19 Claims, 15 Drawing Sheets

DISHWASHER

CROSS-REFERENCE TO RELATED APPLICATION

This application claims the benefit of Korean Patent Application No. 10-2016-0103291, filed on Aug. 12, 2016, whose entire content is hereby incorporated by reference.

TECHNICAL FIELD

The present application relates to technologies related to a dishwasher.

BACKGROUND

A dishwasher is a device that removes filth, such as food waste, from dishes or cooking tools (hereinafter, referred to as 'objects to be washed') using detergent and wash water.

A dishwasher generally includes a tub having therein a washing space, a rack provided in the tub for receiving objects to be washed, a spray arm for spraying wash water to the rack, a sump for storing wash water, and a supply channel for supplying the wash water stored in the sump to the spray arm.

In general, the dishwasher uniformly sprays wash water to objects to be washed, such as dishes, while rotating the spray arm for spraying the wash water to wash the objects. In recent years, there has been developed a dishwasher further including an auxiliary arm configured to roll along an arc track of a spray arm in order to spray wash water, in addition to the spray arm, which is configured to spray wash water during the rotation of the spray arm using rotational force generated when the spray arm rotates.

SUMMARY

In general, one innovative aspect of the subject matter described in this specification can be embodied in a dishwasher including: a tub that includes an interior space; a main arm that is coupled to the tub and that is configured to rotate about a first axis and spray water in the interior space; an auxiliary arm that is coupled to the main arm and that is configured to rotate about a second axis and spray water in the interior space; a stationary gear unit that is coupled to the tub, that is configured to rotate based on rotation of the main arm to generate rotational force, and that includes a plurality of gear teeth; an eccentric rotation unit that is coupled to the main arm, that is engaged with one or more teeth of the plurality of gear teeth of the stationary gear unit, and that is configured to, (i) based on rotation of the main arm, rotate to transfer rotational force of the stationary gear unit to the auxiliary arm and, (ii) based on resistance force from the auxiliary arm, control transfer of rotational force of the stationary gear unit to the auxiliary arm; and a link member that is supported by the main arm, that couples the eccentric rotation unit to the auxiliary arm, and that is configured to rotate the auxiliary arm based on rotational force of the stationary gear unit that is transferred through the eccentric rotation unit.

The foregoing and other implementations can each optionally include one or more of the following features, alone or in combination. In particular, one implementation includes all the following features in combination. The eccentric rotation unit includes: an eccentric part that is coupled to the auxiliary arm through the link member, and an elastic gear that is configured to control transfer of rotational force of the stationary gear unit to the eccentric part based on resistance force from the auxiliary arm. The eccentric part is separated from the elastic gear based on resistance force from the auxiliary arm. The eccentric part includes: a rotary plate that is supported by the elastic gear, a shaft that extends from the rotary plate, the elastic gear being configured to rotate about the shaft, an eccentric protrusion that protrudes from the rotary plate and that is coupled to the link member to transfer rotational force of the stationary gear unit to the auxiliary arm through the link member, and a catching projection (i) that protrudes from the rotary plate, (ii) that is coupled to the elastic gear based on resistance force from the auxiliary arm, and (iii) that is configured to receive rotational force of the stationary gear unit through the elastic gear, and wherein the elastic gear includes: a rotary boss that is coupled to the main arm and supports the shaft, and an elastic part that is located on an inner surface of the elastic gear and that is coupled to the catching projection based on resistance force from the auxiliary arm. The elastic part includes: a plate-shaped leaf spring that extends from the inner surface of the elastic gear and that is coupled to the catching projection based on resistance force from the auxiliary arm. The plate-shaped leaf spring includes at least one elastic portion that has a serpentine shape. The elastic part includes: a leaf spring that includes (i) a first end and a second end, the first end and the second end being coupled to the inner surface of the elastic gear and (ii) a convex portion that is located between the first end and the second end and that is coupled to the catching projection based on resistance force from the auxiliary arm. The leaf spring further includes a concave portion that is not in contact with the catching projection. The leaf spring includes at least one elastic portion that has a serpentine shape. The elastic part includes: at least one pair of elastic portions that are located on the inner surface of the elastic gear and that are arranged to face each other, and a support rib (i) that supports the rotary boss and (ii) that extends from a portion of the inner surface of the elastic gear, the portion of the inner surface of the elastic gear being located between the elastic portions. The rotary plate is located among the support rib and the elastic parts. The link member includes: a ring-shaped body, a first extension part that couples the ring-shaped body to the main arm and that extends in a first direction in which the main arm extends, and a second extension part that couples the ring-shaped body to the auxiliary arm and that extends in a second direction in which the auxiliary arm extends. The main arm includes a guide protrusion, and wherein the first extension part includes a guide recess (i) into which the guide protrusion is inserted and (ii) that is configured to guide the link member. The link member is configured to move in the first direction along the guide protrusion. The eccentric rotation unit includes an eccentric protrusion, and wherein the first extension part includes an insertion hole (i) into which the eccentric protrusion is inserted and (ii) that is configured to guide the link member. The link member is configured to move linearly between a first position and a second position in the first direction. The link member is configured to, based on rotation of the eccentric rotation unit, move linearly between a first position and a second position, and wherein the auxiliary arm is configured to rotate based on linear movement of the link member. The main arm includes: a first spray port that is located at a first portion of the main arm and that is configured to spray water in a third direction, and a second spray port that is located at a second portion of the main arm and that is configured to spray water in a fourth direction that is different from the third direction. The auxiliary arm is configured to spray water to a first position in the interior space while the auxiliary arm rotates. A direction of water that is sprayed from the auxiliary arm is determined based on a gear ratio between the stationary gear unit and the eccentric rotation unit.

The subject matter described in this specification can be implemented in particular implementation so as to realize one or more of the following advantages. Comparing to a conventional dishwasher, a dishwasher includes a structure to prevent damages to parts of the dishwasher. In particular, when an auxiliary arm cannot rotate because of debris such as food particles, resistance force is applied to the auxiliary arm. Since the resistance force is transferred from the auxiliary arm to other parts of the dishwasher, the resistance force can damage other parts of the dishwasher. Thus, when the resistance force satisfies a particular threshold, the dishwasher separates the auxiliary arm from other parts to prevent damages to those parts.

The details of one or more implementations of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
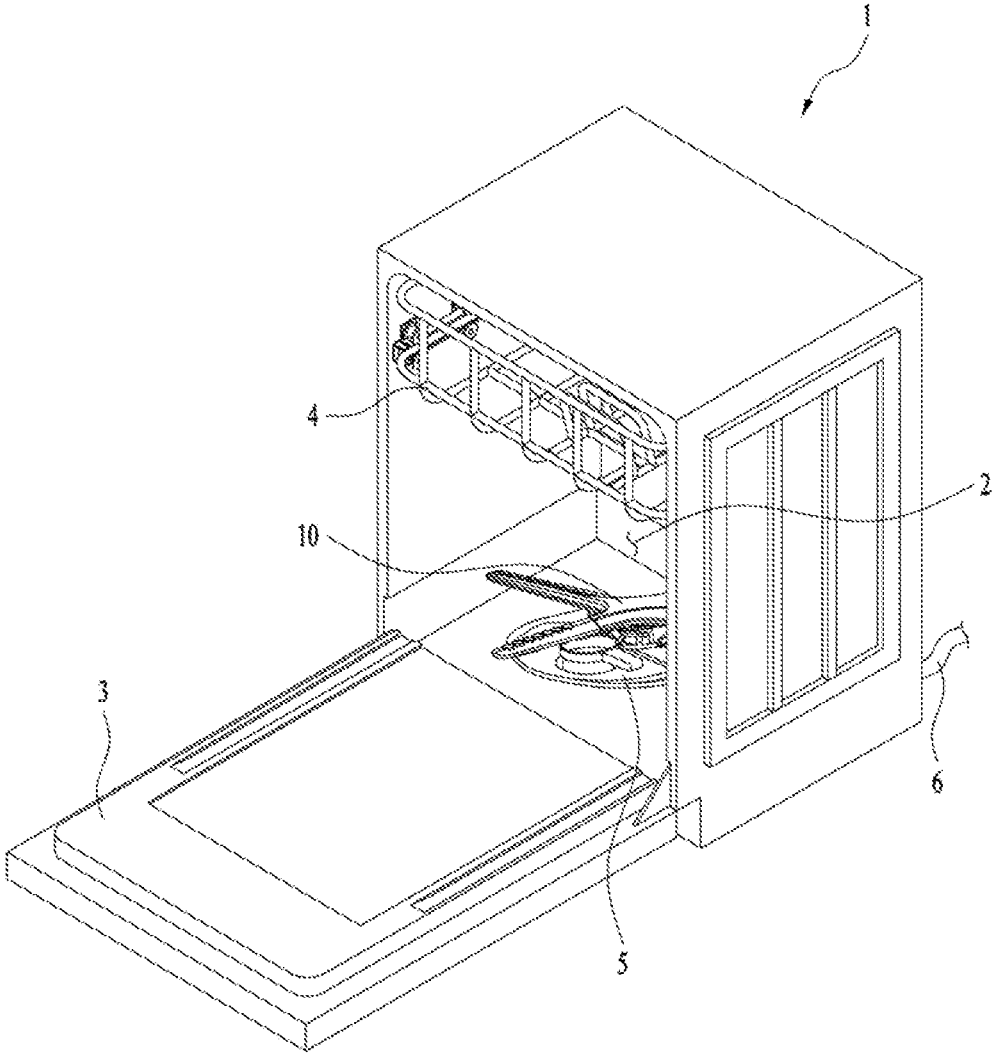
FIG. 1 is a diagram illustrating an example dishwasher.
Figure 2:
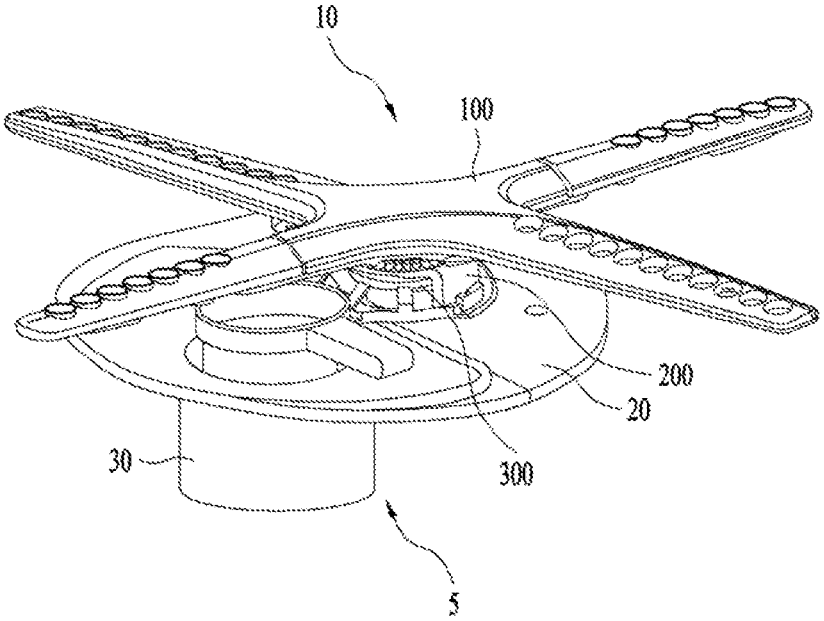
FIGS. 2 to 5 are diagrams illustrating an example spray arm assembly of a dishwasher.

FIG. 1 illustrates an example dishwasher. FIG. 2 illustrates an example spray arm assembly of a dishwasher.

As shown in FIG. 1, a dishwasher 1 may include a tub 2 having a washing space defined therein, a door 3 for selectively opening and closing the washing space, a rack 4 provided in the tub 2 for receiving objects to be washed, a sump 5 provided in the tub 1 for storing wash water, and a spray arm assembly 10 provided in the tub 1 for spraying wash water to the objects received in the rack 3.

The rack 4 may be mounted so as to be capable of being pulled to the front of the tub 2. Consequently, a user may pull the rack 4 to the front of the tub 2 in order to put objects to be washed in the rack 4.

As shown in FIG. 2, the sump 5 may include a sump cover 20 defining the upper surface of the sump 5 and a sump discharge unit 30 provided at the sump cover 20. Wash water sprayed into the tub 2 may be collected into the sump 5 through the sump discharge unit 30.

In addition, a water supply pump to supply wash water stored in the sump 5 to the spray arm assembly 10 may be provided in the sump 5. The wash water collected into the sump 5 may be supplied to the spray arm assembly 10 through the water supply pump provided in the sump 5.

The spray arm assembly 10 may be mounted at the sump cover 20 to spray the wash water stored in the sump 5 to the objects received in the rack 4. The spray arm assembly 10 may include a spray arm 100 for spraying wash water, a stationary gear unit 200 mounted at the sump cover 20 for rotatably supporting the spray arm 100, and an arm holder 300. The spray arm assembly 10 is fastened to the sump cover 20 via the arm holder 300.

In some implementations, wash water may be introduced into the spray arm assembly 10 through the sump 5, and the wash water introduced into the spray arm assembly 10 may be sprayed to objects to be washed through the spray arm 100.

Unlike what is shown in FIG. 1, the spray arm assembly 10 may be provided above the rack 4, rather than under the rack 4. In addition, a plurality of spray arm assemblies 10 may be provided to spray wash water to the upper and lower parts of the rack 4.

Figure 3:
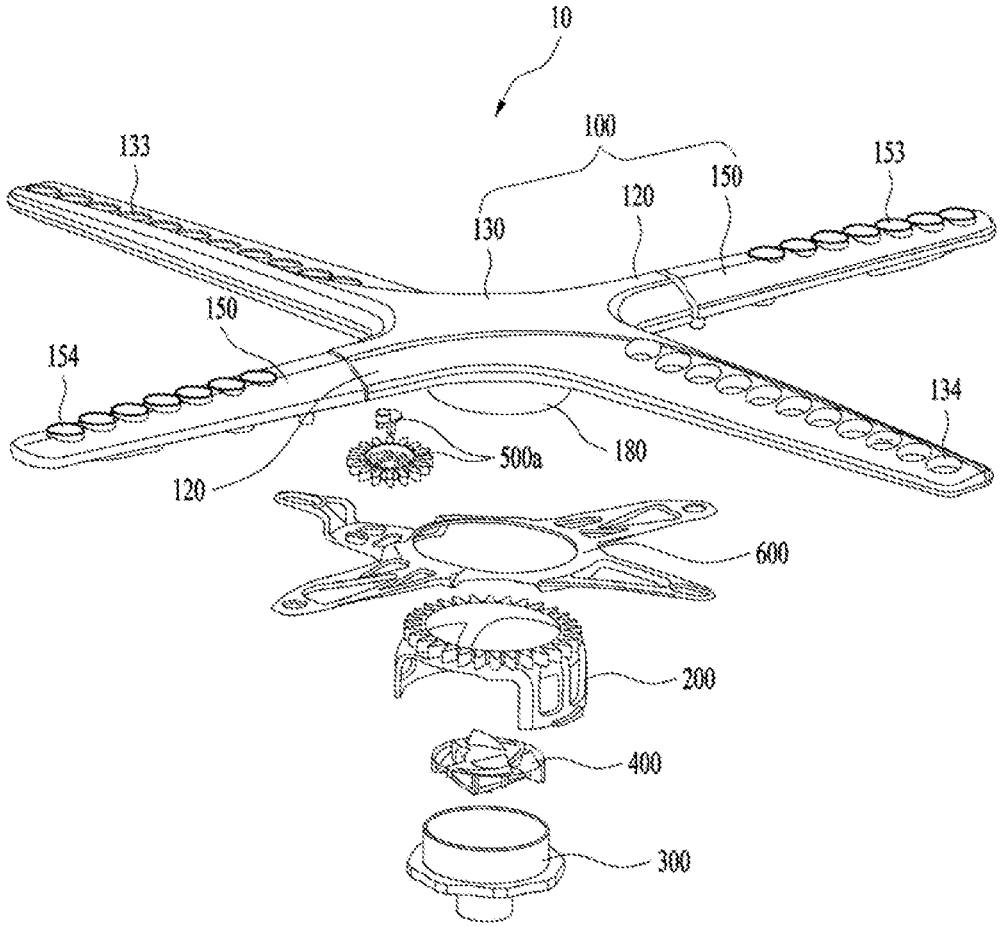

FIG. 3 illustrates an example spray arm assembly of a dishwasher.

As shown in FIG. 3, a spray arm assembly 10 may include a spray arm 100, a stationary gear unit 200, an arm holder 300, a channel switching unit 400, an eccentric rotation unit 500*a*, 500*b*, or 500*c*, and a link member 600.

An arm holder coupling part 180 is provided at the lower surface of the spray arm 100, and the arm holder 300 is provided at the sump cover 20. The arm holder coupling part 180 of the spray arm 100 is coupled to the arm holder 300 of the sump cover 20 such that the spray arm 100 is rotatable (see FIG. 2).

The arm holder 300 may be rotatably fixed to the sump cover 20. That is, the arm holder 300 may serve as a shaft of the spray arm while rotating together with the spray arm 100. In some implementations, wash water supplied to the sump 5 is introduced into the arm holder 300 and is then supplied to the spray arm 100.

The channel switching unit 400 is received in the arm holder 300. When wash water is introduced into the arm holder 300, the water pressure in the arm holder 300 is increased, with the result that the channel switching unit 400 may move upward. When the introduction of wash water into the arm holder 300 is stopped, the water pressure in the arm holder 300 is decreased, with the result that the channel switching unit 400 may move downward.

The spray arm 100 includes a main arm 130 having the arm holder coupling part 180, which is coupled to the arm holder 300, provided at the lower side thereof and rotatable auxiliary arms 150 fastened to the main arm 130.

The main arm 130 and the auxiliary arms 150 may be provided with a plurality of channels, through which wash water supplied from the sump 5 flows. The main arm 130 may be provided at the upper side thereof with spray ports 133 and 134, through which wash water introduced into the main arm 130 is sprayed. Wash water introduced into the main arm 130 from the sump 5 may be sprayed upward from the main arm 300 through the upper spray ports 133.

In addition, the spray ports 133 and 134 formed in the main arm 130 are configured to spray wash water in a direction opposite the direction in which the spray arm 100 rotates about the spray arm 100. The spray arm 100 may rotate by repulsive force of wash water sprayed through the spray ports 133 and 134 depending on the directions in which the spray ports 133 and 134 of the main arm 130 are formed.

Specifically, the spray ports 133 and 134 of the main arm 130 include first spray ports 133 provided at one side of the main arm 130 based on the stationary gear unit 200 to spray wash water to objects to be washed and second spray ports 134 provided at the other side of the main arm 130 based on the stationary gear unit 200 to spray wash water to objects to be washed. The first spray ports 133 and the second spray ports 134 are configured to spray wash water in opposite directions based on the main arm 130. When wash water is sprayed through the first and second spray ports 133 and 134, therefore, the spray arm 100 may rotate.

The auxiliary arms 150 may be mounted at the main arm 130 so as to roll along an arc track. Extension parts 120 may radially extend from the main arm 130. The auxiliary arms 150 may be fastened to the extension parts 120 so as to roll along an arc track.

The auxiliary arms 150 may also be provided with spray ports 153 and 154 for spraying wash water introduced into the main arm 130. The spray ports 153 and 154 of the auxiliary arms 150 include third spray ports 153 provided at one of the auxiliary arms 150 based on the stationary gear unit 200 to spray wash water to objects to be washed and fourth spray ports 154 provided at the other of the auxiliary arms 150 based on the stationary gear unit 200 to spray wash water to objects to be washed.

The third spray ports 153 and the fourth spray ports 154 formed in the auxiliary arms 150 are configured to spray wash water in the same direction based on the center of rotation of the main arm 130. That is, the spray arm 100 rotates by repulsive force of wash water sprayed through the spray ports 133 and 134 formed in the main arm 130, irrespective of the direction in which wash water is sprayed through the third spray ports 153 and the fourth spray ports 154.

In some implementations, the auxiliary arms 150 roll with respect to the main arm 130. The direction in which wash water is sprayed through the third spray ports 153 and the fourth spray ports 154 may be configured to be opposite the direction in which wash water is sprayed through the first and second spray ports 133 and 134 of the main arm 130 during rolling of the auxiliary arms 150.

In the case in which the direction in which wash water is sprayed through the first and second spray ports 133 and 134 and the direction in which wash water is sprayed through the third and fourth spray ports 153 and 154 are opposite to each other, the rotational force of the spray arm 100 may be reduced. Consequently, it is necessary to minimize the effect of the repulsive force of the wash water sprayed through the third and fourth spray ports 153 and 154 of the auxiliary arms 150 with respect to the repulsive force of the wash water sprayed through the first and second spray ports 133 and 134 of the main arm 130.

The third and fourth spray ports 153 and 154 of the auxiliary arms 150 are configured to spray wash water in the same direction based on the center of rotation of the main arm 130 during rolling of the auxiliary arms 150, whereby it is possible to offset the repulsive force of the wash water sprayed through the third and fourth spray ports 153 and 154.

The main arm 130 and each auxiliary arm 150 may be spaced apart from each other by a suitable angle based on the stationary gear unit 200. For example, the main arm having the first spray ports 133 and the auxiliary arm 150 having the third spray ports 153 may be spaced apart from each other by an acute or right angle. In addition, the main arm having the first spray ports 133 and the auxiliary arm 150 having the fourth spray ports 154 may be spaced apart from each other by an obtuse or right angle.

Transfer channels, along which wash water introduced from the sump 5 flows, may be formed in the extension parts 120. The wash water flowing along the transfer channels may be introduced into auxiliary channels provided in the auxiliary arms 150. Consequently, the wash water introduced into the auxiliary channels formed in the auxiliary arms 150 may be sprayed through the third and fourth spray ports 153 and 154.

In the above description, the spray arm 100 rotates by the repulsive force of wash water sprayed through the first spray ports 133 and the second spray ports 134 formed in the main arm 130. Alternatively, the spray arm 100 may rotate by an additional driving device that provides power necessary to rotate the spray arm 100, such as a motor.

Figure 4:
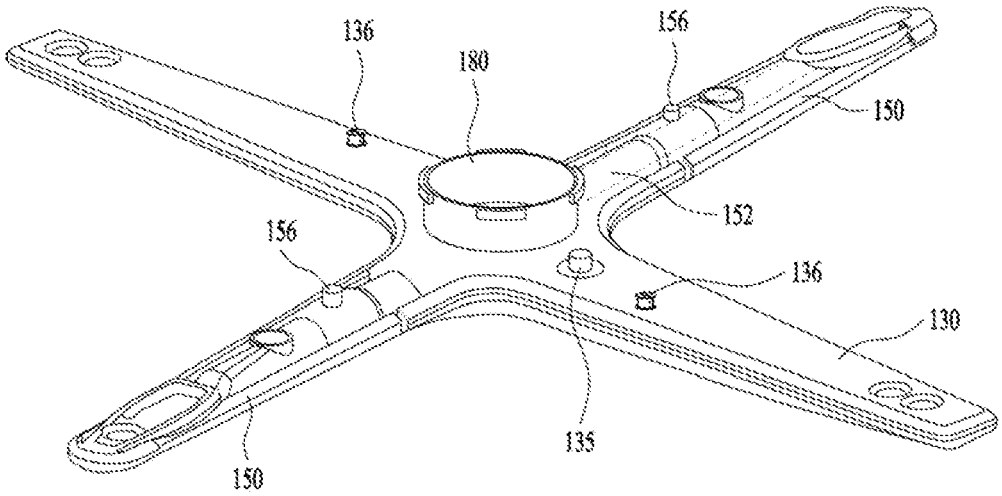

FIG. 4 illustrates an example spray arm assembly of a dishwasher.

As shown in FIG. 4, the main arm 130 may include a gear shaft 135, which serves as a shaft inserted into the eccentric rotation unit 500*a*, 500*b*, or 500*c* to serve as a shaft of the eccentric rotation unit 500*a*, 500*b*, or 500*c*. The gear shaft 135 protrudes from a lower frame of the main arm 130. The gear shaft 135 may be formed in the shape of a boss having a center and an outer circumferential surface.

That is, a shaft hole 135*a* (see FIG. 8), into which an eccentric part 520*a*, 520*b*, or 520*c* of the eccentric rotation unit 500*a*, 500*b*, or 500*c* is rotatably inserted, is formed in the center of the gear shaft 135. The outer circumferential surface of the gear shaft 135 is inserted into an elastic gear 510*a*, 510*b*, or 510*c* of the eccentric rotation unit 500*a*, 500*b*, or 500*c* to serve as a shaft of the elastic gear 510*a*, 510*b*, or 510*c*. Examples of the eccentric rotation unit 500*a*, 500*b*, or 500*c* are described in greater detail with reference to FIGS. 8 to 13.

In some implementations, the gear shaft 135 may be located at the lower surface of the main arm 130, as shown. However, In some other implementations, the gear shaft 135 can be located at other surface of the main arm 130. In addition, the main arm 130 may include a guide protrusion 136 to guide the movement of the link member 600.

As shown in FIG. 4, each auxiliary arm 150 may include a power transmission part 156 to receive power from the link member 600. The power transmission part 156 may be a protrusion protruding downward from the lower surface of each auxiliary arm 150. Each auxiliary arm 150 is provided therein with an auxiliary channel 152, into which wash water is introduced. One side of the auxiliary channel 152 is inserted into an extension pipe 172 of the main arm 130.

Figure 5:
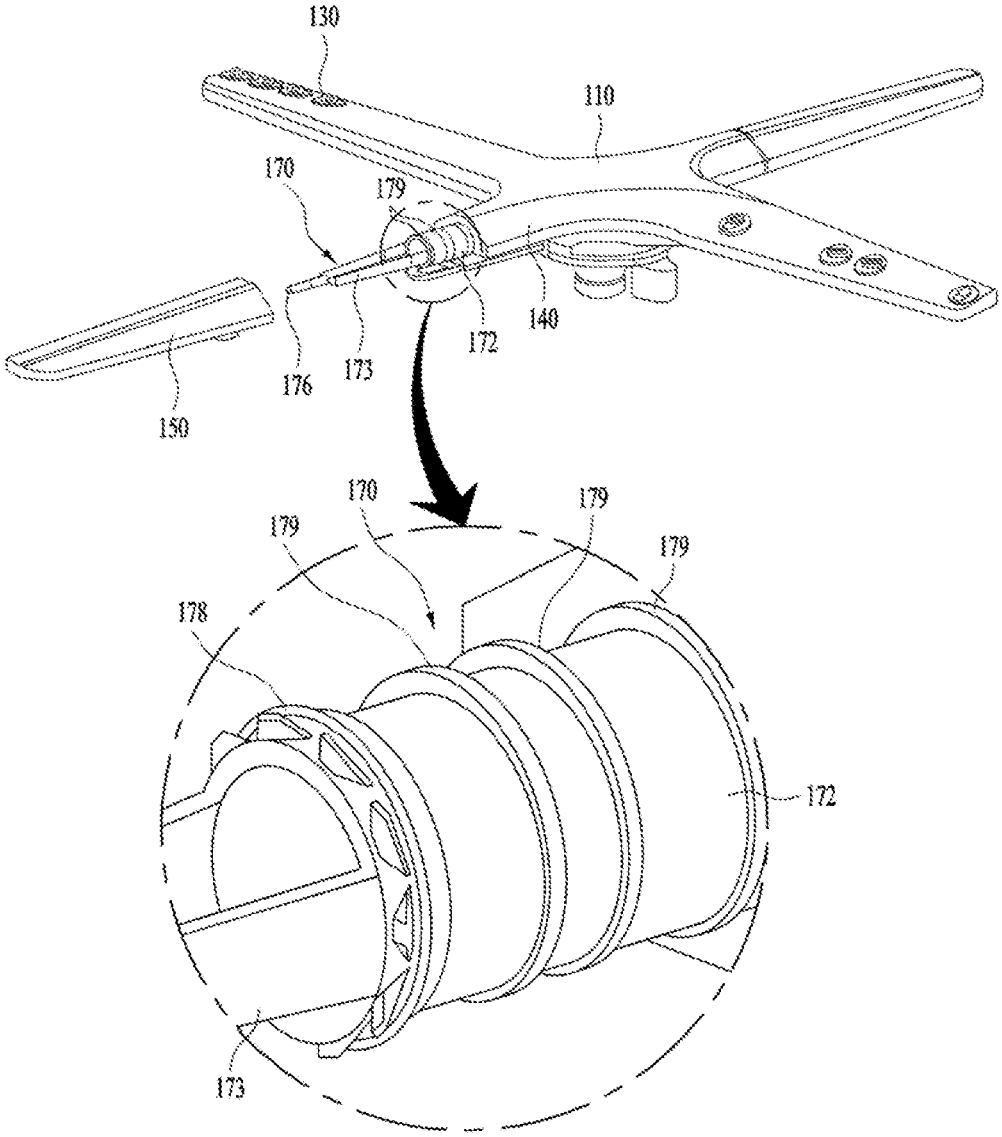

FIG. 5 illustrates an example spray arm assembly of a dishwasher.

As shown in FIG. 5, each auxiliary arm connection member 170 includes an extension pipe 172 integrally formed at the main arm 130, a channel part 173 extending from the extension pipe 172 for defining a wash water channel, and a shaft 176 extending from the channel part 173 so as to be inserted into the auxiliary channel 152 of a corresponding one of the auxiliary arms 150.

The extension pipe 172 is provided at the outer circumferential surface thereof with a plurality of sealing ribs 179 protruding from the outer circumferential surface of the extension pipe 172 to minimize the leakage of water from between the auxiliary channel 152 of a corresponding one of the auxiliary arms 150 and the extension pipe 172. In addition, the extension pipe 172 is provided at the outer circumferential surface of the end thereof with a plurality of support protrusions 178 to support the auxiliary channel 152 with respect to the extension pipe 172 while minimizing the contact area therebetween.

The shaft 176 is inserted into the auxiliary channel 152 formed in a corresponding one of the auxiliary arms 150.

Wash water supplied from the channel part 173 flows in the auxiliary channel 152. The wash water flowing in the auxiliary channels 152 is sprayed outward through the spray ports 153 and 154.

Figure 6:
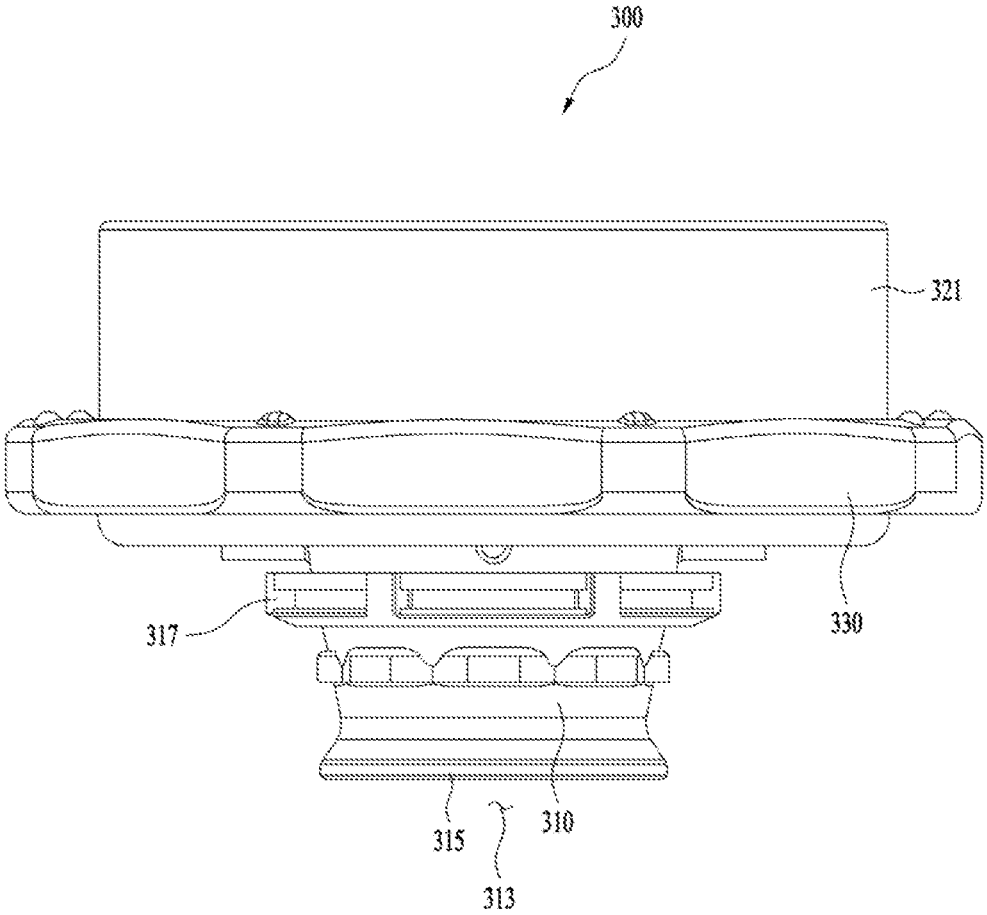
FIG. 6 is a diagram illustrating an example arm holder of a dishwasher.

FIG. 6 illustrates an example arm holder of a dishwasher.

As shown in FIG. 6, the arm holder 300 may include an introduction part 310, into which the wash water stored in the sump 5 is introduced, and a coupling part 330 coupled to the spray arm 100. The introduction part 310 may be provided with a hollow portion, into which the wash water stored in the sump 5 is supplied. Consequently, the wash water stored in the sump 5 may be introduced into the arm holder 300 through the hollow portion provided in the introduction part 310.

The introduction part 310 may include a separation prevention part 315 for preventing the arm holder 300 from being separated from the sump cover 20. The separation prevention part 315 may be formed by increasing the diameter of the end of the introduction part 310.

The separation prevention part 315 may be fastened to the sump cover 20. Consequently, the introduction part 310 may be rotatably fixed to the sump cover 20. The arm holder 300 may be received in the inner circumferential surface of the arm holder coupling part 180 provided at the lower surface of the spray arm 100 (see FIG. 3).

Figure 7:
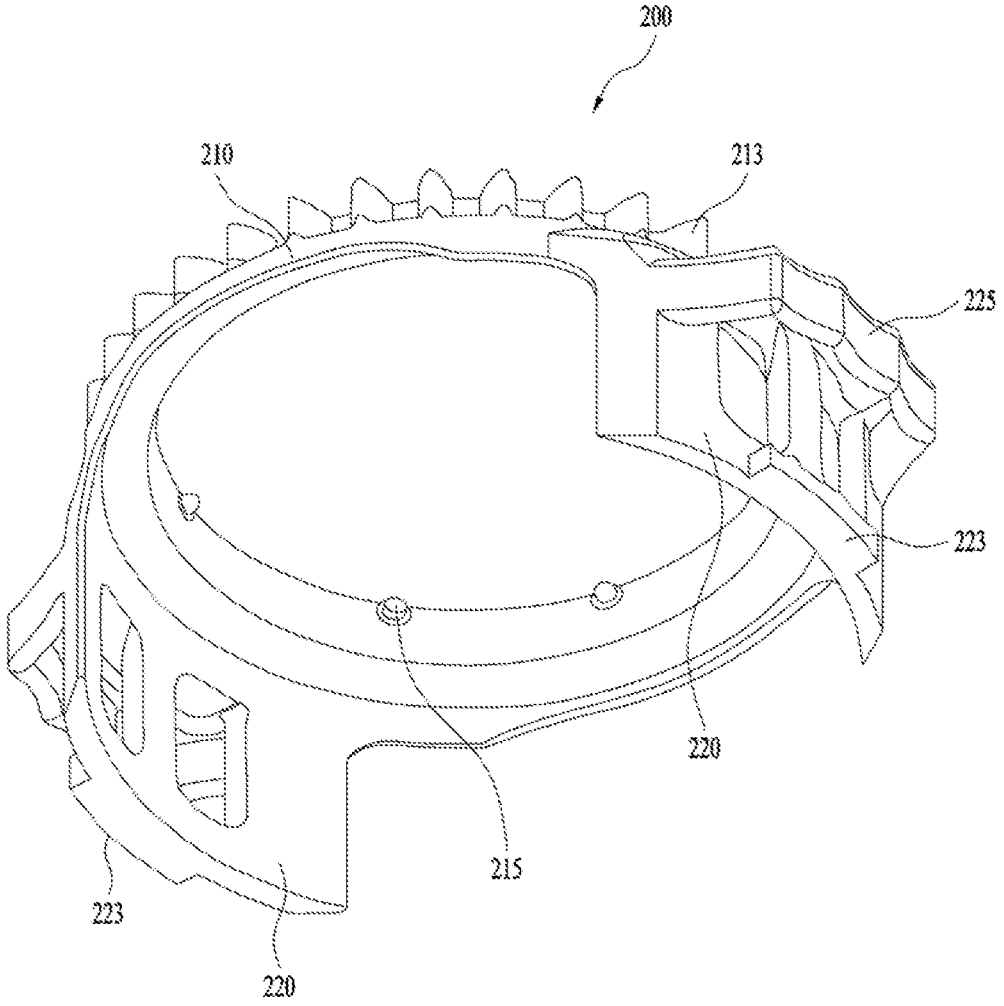
FIG. 7 is a diagram illustrating an example stationary gear unit of a dishwasher.

FIG. 7 illustrates an example stationary gear unit of a dishwasher.

As shown in FIG. 7, the stationary gear unit 200 is coupled to the sump cover 20 by fastening a fastening part 223 provided at the stationary gear unit 200 to the sump cover 20. The stationary gear unit 200 is fixed so as not to be rotatable, unlike the arm holder 300.

A stationary gear unit 200 of the present invention may include a rim part 210 having a plurality of gear teeth 213 and a support part 220 extending downward from the rim part 210. The arm holder coupling part 180 may be inserted into the rim part 210.

The rim part 210 may include a gap reduction protrusion 215 to reduce the gap between the rim part 210 and the arm holder coupling part 180. A plurality of gap reduction protrusions 215 may be provided, and may protrude toward the center of the rim part 210.

Support parts 220 may be provided at opposite sides of the rim part 210. In addition, the support part 220 may include a fastening part 223 coupled to the sump cover 20. The fastening part 223 may be a protrusion protruding from the side surface of the support part 220. The fastening part 223 is fastened to the sump cover 20, whereby the stationary gear unit 200 may be fixed to the sump cover 20.

In some implementations, the support part 220 may further include a handle 225, which a user may hold in order to couple the stationary gear unit 200 to the sump cover 20 or to separate the stationary gear unit 200 from the sump cover 20. The handle 225 may extend in the radial direction of the stationary gear unit 200. In addition, at least a portion of the surface of the handle 225 may protrude or may be recessed such that the user can easily hold the handle 225.

The eccentric rotation unit 500*a*, 500*b*, or 500*c* is rotatably mounted at the lower part of the spray arm 100. The eccentric rotation unit 500*a*, 500*b*, or 500*c* rotates based on rotation of the stationary gear unit 200. For example, the gear teeth of the eccentric rotation unit 500*a*, 500*b*, or 500*c* can be coupled to the gear teeth of the stationary gear unit 200. The eccentric rotation unit 500*a*, 500*b*, or 500*c* converts rotational force of the stationary gear unit 200 into linear reciprocation. Based on linear reciprocation of the eccentric rotation unit 500*a*, 500*b*, or 500*c*, the link member 600 is moved. In particular, the eccentric rotation unit 500*a*, 500*b*, or 500*c* selectively transfers the rotational force of the stationary gear unit 200 to the link member 600 or controls the transfer of the rotational force of the stationary gear unit 200 to the link member 600 depending on whether the rotation of the auxiliary arm 150 is allowed or restricted.

Figure 8:
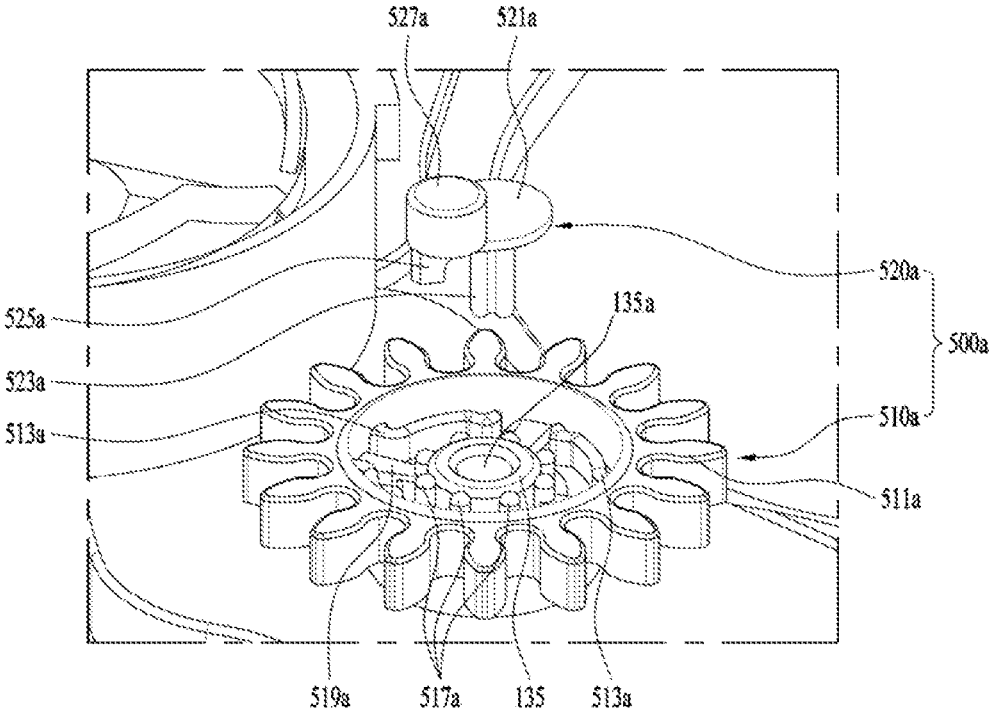
FIGS. 8 to 13 are diagrams illustrating an example eccentric rotation unit of a dishwasher.
Figure 9:
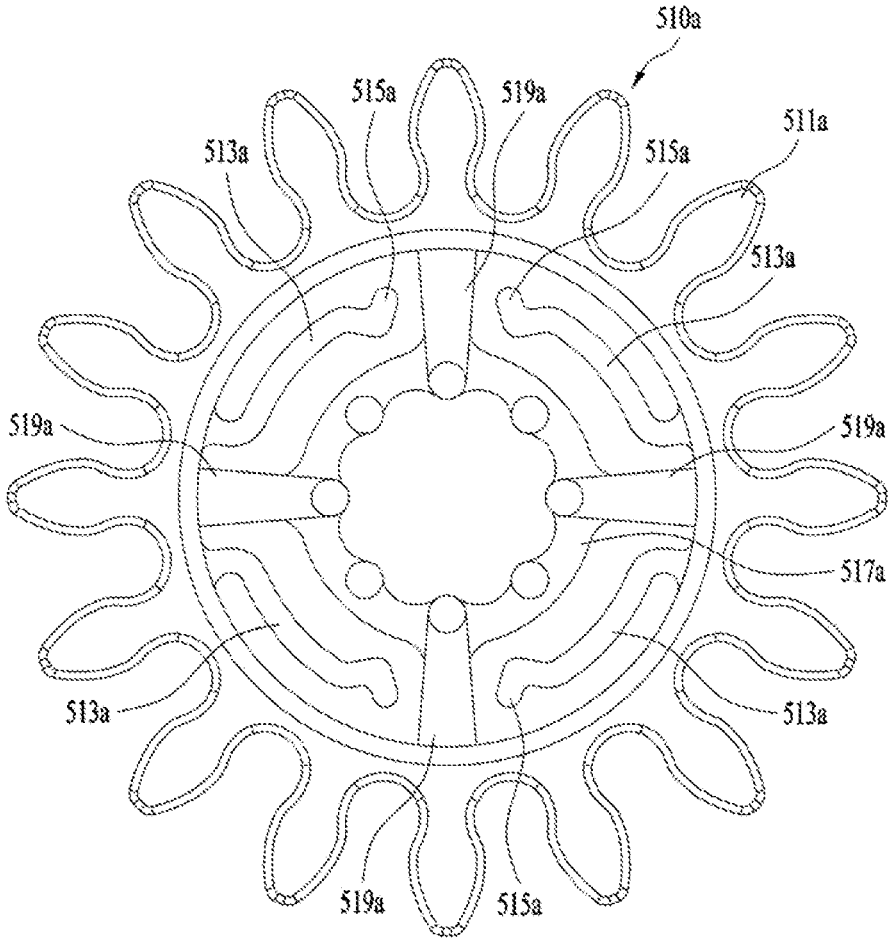

FIGS. 8 and 9 illustrate an example eccentric rotation unit of a dishwasher.

The eccentric rotation unit 500*a* includes an eccentric part 520*a* and an elastic gear 510*a*. The eccentric part 520*a* is rotatably inserted into a shaft hole 135*a* of a gear shaft 135 of the spray arm 100 for converting rotational force into linear reciprocation. The elastic gear 510*a* is rotatably coupled to the outer circumferential surface of the gear shaft 135 of the spray arm 100 to receive rotational force from the stationary gear unit 200. The elastic gear 510*a* transfers rotational force of the stationary gear unit 200 to the eccentric part 520*a*. In some implementations, the elastic gear 510*a* can selectively transfer rotational force to the eccentric part 520*a* using suitable elastic force depending on the load of the eccentric part 520*a* based on the restriction of the auxiliary arm 150.

The elastic gear 510*a* is formed in the shape of a ring, on the outer circumferential surface of which a plurality of gear teeth 511*a* configured to be engaged with the gear teeth 213 of the stationary gear unit 200 is formed. The elastic gear 510*a* includes, at the center portion of the elastic gear 510*a*, a rotary boss 517*a* for rotatably supporting the outer circumferential surface of the gear shaft 135. The elastic gear 510*a* includes, on the inner circumferential surface of the elastic gear 510*a*, a protrusion spring 513*a* that is spaced apart from the rotary boss 517*a* so as to contact the eccentric part 520*a* with a suitable elastic force.

The rotary boss 517*a* is supported in the center of the elastic gear 510*a* by a plurality of support ribs 519*a* extending from the lower part of the inner circumferential surface of the elastic gear 510*a*. In some implementations, the rotary boss 517*a* can be formed in the shape of a general boss. In some other implementations, the rotary boss 517*a* is formed in a shape including a plurality of protrusions to support the outer circumferential surface of the gear shaft 135 in a line contact state in order to minimize friction with the gear shaft 135 and wear of the rotary boss 517*a*.

In some implementations, the protrusion spring 513*a* is formed in the shape of a leaf spring having a suitable length. One end of the protrusion spring 513*a* is integrally formed at the inner circumferential surface of the elastic gear 510*a*, and the other end of the protrusion spring 513*a* extends into a space between the inner circumferential surface of the elastic gear 510*a* and the rotary boss 517*a* along the inner circumferential surface of the elastic gear 510*a*. A catching protrusion 515*a* configured to contact the eccentric part 520*a* with a suitable elastic force is formed at the end of the protrusion spring 513*a*. Preferably, at least two protrusion springs 513*a* are formed on the inner circumferential surface of the elastic gear 510*a*. In this example, four protrusion springs 513*a* are provided.

The eccentric part 520*a* includes a shaft 523*a* rotatably inserted into the shaft hole 135*a* of the gear shaft 135 formed in the spray arm 100, a rotary plate 521*a* formed at the upper part of the shaft 523*a*, an eccentric protrusion 527*a* spaced apart from the shaft 523*a* by a suitable distance to protrude from the rotary plate 521*a* at a position opposite the shaft 523*a* so as to be eccentric with respect to the shaft 523*a*, and a catching projection 525*a* formed on the outer circumferential surface of the shaft 523*a* to come into contact with the catching protrusion 515*a* of the protrusion spring 513*a*, formed at the elastic gear 510*a*, when the eccentric part 520*a* rotates about the shaft hole 135*a*.

In the eccentric rotation unit 500*a*, the elastic gear 510*a* of the eccentric rotation unit 500*a*, which is engaged with the stationary gear unit 200, rotates together with the spray arm 100 as the spray arm 100 rotates. As the elastic gear 510*a* rotates, the catching projection 525*a* of the eccentric part 520*a* is caught by the catching protrusion 515*a* of the protrusion spring 513*a*, formed at the elastic gear 510*a*, with the result that the eccentric part 520*a* rotates simultaneously when the elastic gear 510*a* rotates.

The eccentric protrusion 527*a* of the eccentric part 520*a* is inserted into an insertion hole 625 of the link member 600, a description of which will follow, to convert rotational force into linear motion and to transfer the linear motion to the link member 600. The auxiliary arm 150 rotates by the link member 600 in a reciprocating fashion.

In some implementations, when the operation of the auxiliary arm 150 is restricted, the elastic gear 510*a* and the eccentric part 520*a* of the eccentric rotation unit 500*a* control the transfer of the operating force from the stationary gear unit 200 to the link member 600 via the eccentric rotation unit 500*a* to prevent the rotational force of the stationary gear unit 200 from being transferred to the link member 600.

In particular, where the auxiliary arm 150 cannot rotate in the interior space of the tub 2, e.g., debris such as food particles disturbs the auxiliary arm 150 to rotate, if rotational force of the stationary gear unit 200 is applied to the auxiliary arm 150 through the eccentric rotation unit 500*a* and the link member 600, excessive load can be applied to the stationary gear unit 200, the eccentric rotation unit 500*a*, and the link member 600 and cause damages to the stationary gear unit 200, the eccentric rotation unit 500*a*, and the link member 600. To prevent the damages, the transfer of rotational force from the stationary gear unit 200 to the auxiliary arm 150 can be controlled.

In some implementations, when the operation of the auxiliary arm 150 is restricted, the motion of the link member 600, which transfers power to the auxiliary arm 150, is also restricted in response to the restriction of the operation of the auxiliary arm 150. In addition, the movement of the eccentric protrusion 527*a* of the eccentric part 520*a*, which is inserted into the insertion hole 625 of the link member 600 to reciprocate the link member 600, is also restricted as the movement of the link member 600 is restricted. As a result, the rotation of the eccentric part 520*a* is restricted.

The stationary gear unit 200 rotates with the main arm 130. The elastic gear 510*a* of the eccentric rotation unit 500*a* is engaged with the stationary gear unit 200 such that the elastic gear 510*a* rotates based on rotation of the stationary gear unit 200. That is, the elastic gear 510*a* rotates by the rotational force of the stationary gear unit 200.

The catching protrusion 515*a* formed on the protrusion spring 513*a* of the elastic gear 510*a* can be separated from the catching projection 525*a* of the eccentric part 520*a* while the elastic gear 510*a* rotates. Once the catching protrusion 515*a* of the elastic gear 510*a* that receives rotational force from the stationary gear unit 200 is separated from the catching projection 525*a* of the eccentric part 520*a*, the eccentric part 520 does not rotate even if the elastic gear 510*a* continuously rotates. Thus, the transfer of rotational force from the stationary gear unit 200 to the eccentric rotation unit 500*a* is disconnected between the elastic gear 510*a* and the eccentric part 520*a* by separating the catching protrusion 515*a* from the catching projection 525*a*. As a result, rotational force of the eccentric rotation unit 500*a* is not transferred to the link member 600.

Figure 10:
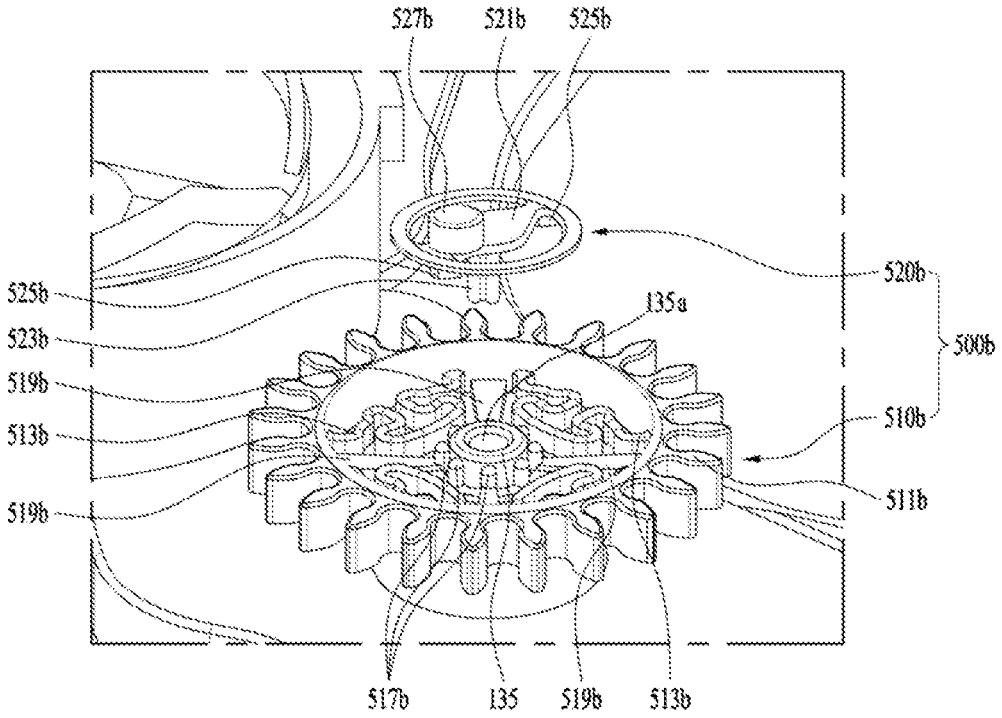
Figure 11:
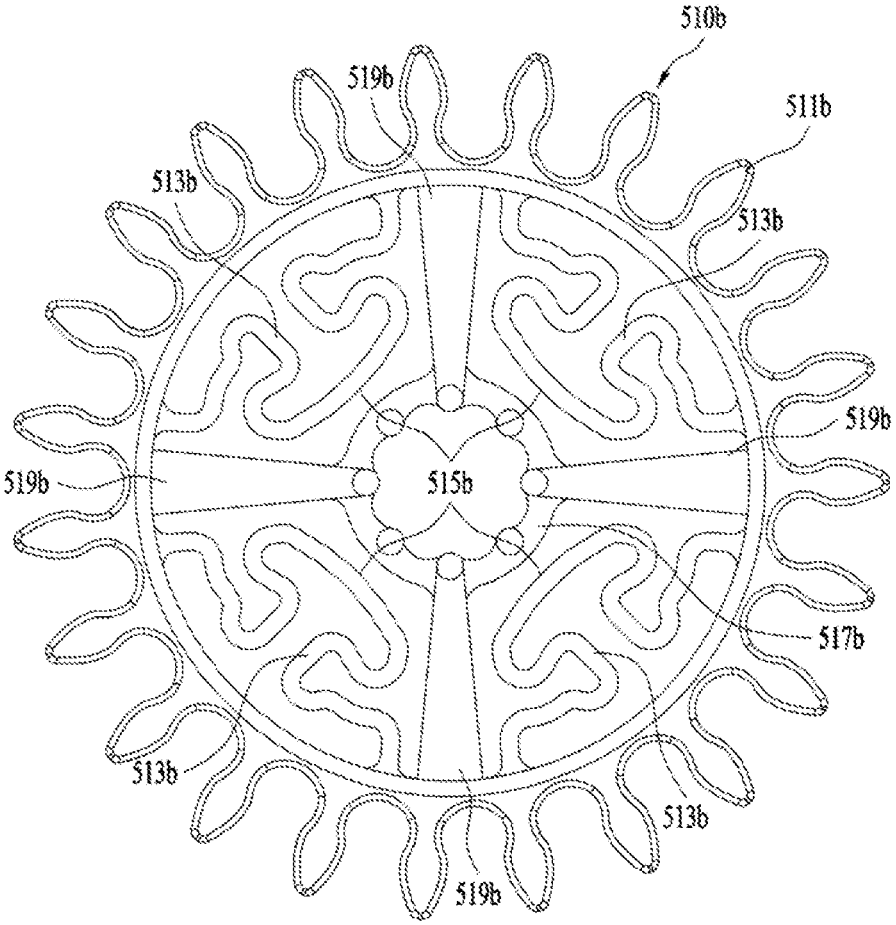

FIGS. 10 and 11 illustrate another example eccentric rotation unit of a dishwasher.

The eccentric rotation unit 500*b* includes an eccentric part 520*b* rotatably inserted into a shaft hole 135*b* of a gear shaft 523*b* of the spray arm 100 for converting rotational force into linear reciprocation and an elastic gear 510*b* rotatably coupled to the outer circumferential surface of the gear shaft 523*b* of the spray arm 100 to receive the rotational force from the stationary gear unit 200 and selectively transferring rotational force to the eccentric part 520*b* using a suitable elastic force depending on the load of the eccentric part 520*b* based on the restriction of the auxiliary arm 150.

The elastic gear 510*b* is formed in the shape of a ring, on the outer circumferential surface of which a plurality of gear teeth 511*b* configured to be engaged with the gear teeth 213 of the stationary gear unit 200 is formed. The elastic gear 510*b* is provided at the center portion thereof with a rotary boss 517*b* for rotatably supporting the outer circumferential surface of the gear shaft 523*b*. The elastic gear 510*b* is provided on the inner circumferential surface thereof with at least two opposing closed springs 513*b* spaced apart from the rotary boss 517*b* so as to contact the eccentric part 520*b* with a suitable elastic force.

The rotary boss 517*b* is supported in the center of the elastic gear 510*b* by a plurality of support ribs 519*b* extending from the lower part of the inner circumferential surface of the elastic gear 510*b*. The rotary boss 517*b* may be formed in the shape of a general boss. Preferably, however, the rotary boss 517*b* is formed in a shape including a plurality of protrusions to support the outer circumferential surface of the gear shaft 523*b* in a line contact state in order to minimize friction with the gear shaft 523*b* and wear of the rotary boss 517*b*.

In some implementations, each closed spring 513*b* is formed in the shape of a leaf spring having a suitable length. One end and the other end of each closed spring 513*b* are integrally formed at the inner circumferential surface of the elastic gear 510*b*, and the middle part of each closed spring 513*b* protrudes toward the rotary boss 517*b*.

More specifically, each closed spring 513*b* is formed in a 'Ω' shape. Open sides of each closed spring 513*b* are integrally formed at the inner circumferential surface of the elastic gear 510*b*, and a protrusion formed at the middle part of each closed spring 513*b* extends toward the rotary boss 517*b*, which is formed at the elastic gear 510*b*.

A convex catching surface 515*b* configured to contact a catching projection 525*b* of the eccentric part 520*b*, a description of which will follow, is formed at the outside surface of the middle part of each closed spring 513*b* extending toward the rotary boss 517*b*. The catching projection 525*b* of the eccentric part 520*b* and the convex catching surface 515*b* contact each other in a surface contact fashion. For example, when the auxiliary arm 150 cannot rotate, e.g., debris such as food particles disturbs the auxiliary arm 150 to rotate, resistance force from the auxiliary arm 150 causes a pressure to the eccentric rotation unit 500*b* through the link member 600. When particular pressure is applied to each closed spring 513*b*, the closed spring 513*b* is elastically deformed, whereby the catching projection 525*b* and the convex catching surface 515*b* may slide and may be separated from each other.

At least one pair of closed springs 513*b* may be provided at the inner circumferential surface of the elastic gear 510*b* so as to be opposite each other. The closed springs 513*b* may be located in a symmetrical fashion. In this example, four closed springs 513*b* are provided.

The eccentric part 520*b* includes a shaft 523*b* rotatably inserted into the shaft hole 135*b* of the gear shaft 523*b* formed in the spray arm 100, a rotary plate 521*b* formed at the upper part of the shaft 523*b*, an eccentric protrusion 527*b* spaced apart from the shaft 523*b* by a suitable distance to protrude from the rotary plate 521*b* at a position opposite the shaft 523*b* so as to be eccentric with respect to the shaft 523*b*, and at least one catching projection 525*b* formed on the outer circumferential surface of the shaft 523*b* to come into contact with the convex catching surface 515*b* of each closed spring 513*b*, formed at the elastic gear 510*b*, when the eccentric part 520*b* rotates about the shaft hole 135*b*.

In some implementations, a pair of catching projections 525*b* is formed in a symmetrical fashion so as to correspond to the closed springs 513*b*. In the case in which a pair of catching projections 525*b* is provided, therefore, the catching projections 525*b* are configured to contact convex catching surfaces 515*b* formed at a pair of closed springs 513*b*.

In the eccentric rotation unit 500*b*, the elastic gear 510*b* of the eccentric rotation unit 500*b*, which is engaged with the stationary gear unit 200, rotates together with the spray arm 100 when the spray arm 100 rotates, and as the elastic gear 510*b* rotates, the catching projections 525*b* of the eccentric part 520*b* are caught by the convex catching surfaces 515*b* of the closed springs 513*b*, formed at the elastic gear 510*b*, with the result that the eccentric part 520*b* rotates simultaneously when the elastic gear 510*b* rotates.

The eccentric protrusion 527*b* of the eccentric part 520*b* is inserted into an insertion hole 625 of the link member 600, a description of which will follow, to convert rotational force into linear motion and to transfer the linear motion to the link member 600. The auxiliary arm 150 rotates by the link member 600 in a reciprocating fashion.

In some implementations, when the operation of the auxiliary arm 150 is restricted, the elastic gear 510*b* and the eccentric part 520*b* of the eccentric rotation unit 500*b* interrupt the transfer of the operating force from the stationary gear unit 200 to the link member 600 via the eccentric rotation unit 500*b* to prevent the rotational force of the stationary gear unit 200 from being transferred to the link member 600.

That is, if the rotational force generated by the rotation of the main arm 130 is transferred to the auxiliary arm 150 via the stationary gear unit 200 and the eccentric rotation unit 500*b* as operating force when the operation of the auxiliary arm 150 is restricted due to a specific reason, noise due to separation between the gear teeth 213 and 511*b* may be generated between the stationary gear unit 200 and the eccentric rotation unit 500*b*, through which power is transferred to the auxiliary arm 150, or the link member 600, which transfers the power to the auxiliary arm 150, may be damaged. When the operation of the auxiliary arm 150 is restricted, therefore, it is necessary to interrupt the transfer of operating force to the auxiliary arm 150.

If the power from the stationary gear unit 200, the eccentric rotation unit 500*b*, and the link member 600 is transferred to the auxiliary arm 150 when the rotation of the auxiliary arm 150 is restricted (for example, when foreign matter is inserted between the auxiliary arm connection member 170 and the auxiliary arm 150, with the result that the rotation of the auxiliary arm 150 is impossible), an excessive load may be applied to the stationary gear unit 200, the eccentric rotation unit 500*b*, and the link member 600, and noise may be generated, since the rotation of the auxiliary arm 150 is restricted.

In addition, if power is continuously transferred through the stationary gear unit 200, the eccentric rotation unit 500*b*, and the link member 600 in the state in which the rotation of the auxiliary arm 150 is restricted, the stationary gear unit 200, the eccentric rotation unit 500*b*, and the link member 600, which transfer power to the auxiliary arm 150, may be damaged.

In some implementations, when the operation of the auxiliary arm 150 is restricted, the motion of the link member 600, which transfers power to the auxiliary arm 150, is also restricted in response to the restriction of operation of the auxiliary arm 150. In addition, the movement of the eccentric protrusion 527*b* of the eccentric part 520*b*, which is inserted into the insertion hole 625 of the link member 600 to reciprocate the link member 600, is also restricted as the movement of the link member 600 is restricted. As a result, the rotation of the eccentric part 520*b* is restricted.

The elastic gear 510*b* of the eccentric rotation unit 500*b*, which is engaged with the stationary gear unit 200 while rotating together with the main arm 130 when the main arm 130 rotates, rotates by the rotational force of the stationary gear unit 200. The convex catching surfaces 515*b* formed on the closed springs 513*b* of the elastic gear 510*b* may be separated from the catching projections 525*b* of the eccentric part 520*b*, whereby the elastic gear 510*b* may rotate.

That is, the convex catching surfaces 515*b* formed on the closed springs 513*b* of the elastic gear 510*a* of the eccentric rotation unit 500*b*, which receives rotational force from the stationary gear unit 200, are separated from the catching projections 525*b* of the eccentric part 520*b*, with the result that the elastic gear 510*b* may be continuously rotated irrespective of the restriction of rotation of the eccentric part 520*b*.

In the case in which the rotation of the auxiliary arm 150 is restricted when the spray arm 100 rotates, therefore, the rotational force transferred from the stationary gear unit 200 to the eccentric rotation unit 500*b* by the rotation of the spray arm 100 (i.e. the main arm 130) is interrupted between the elastic gear 510*b* and the eccentric part 520*b* of the eccentric rotation unit 500*b*, thereby preventing the rotational force of the eccentric rotation unit 500*b* from being transferred to the link member 600.

Figure 12:
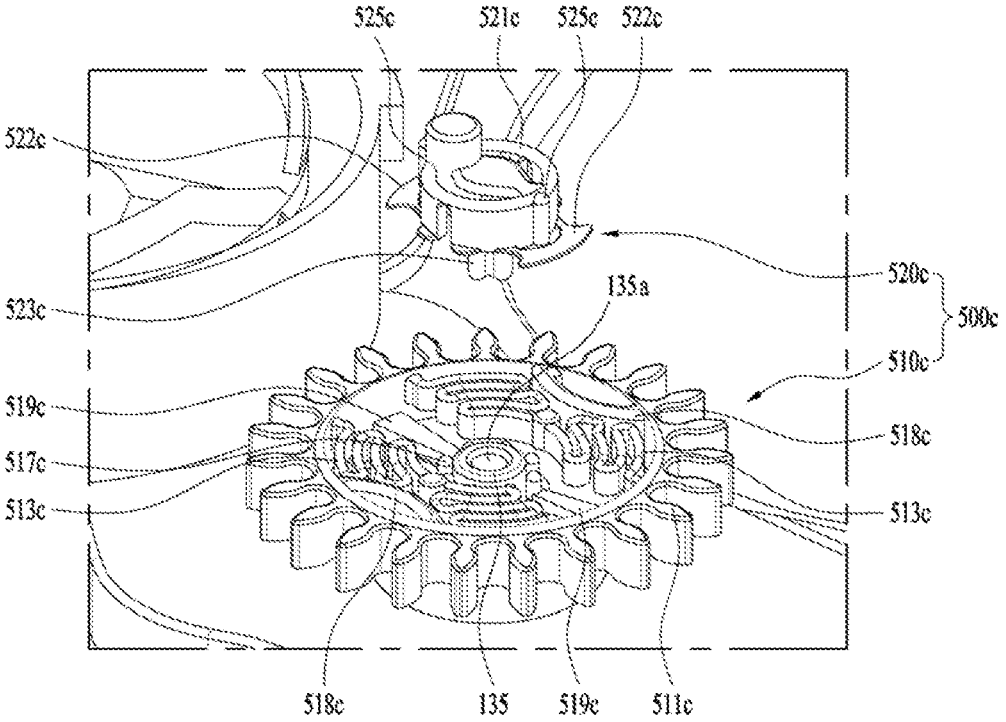
Figure 13:
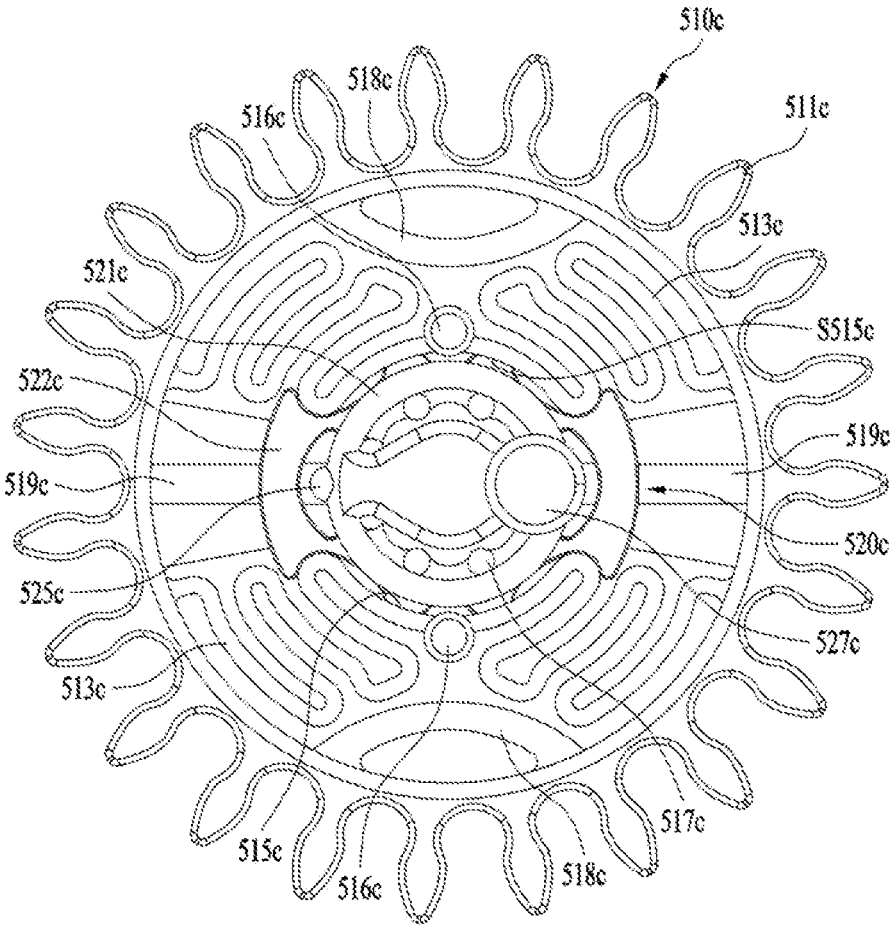

FIGS. 12 and 13 illustrate another example eccentric rotation unit of a dishwasher.

The eccentric rotation unit 500*c* includes an eccentric part 520*c* rotatably inserted into a shaft hole 135*c* of a gear shaft 523*c* of the spray arm 100 for converting rotational force into linear reciprocation and an elastic gear 510*c* rotatably coupled to the outer circumferential surface of the gear shaft 523*c* of the spray arm 100 to receive the rotational force from the stationary gear unit 200 and selectively transferring rotational force to the eccentric part 520*c* using a suitable elastic force depending on the load of the eccentric part 520*c* based on the restriction of the auxiliary arm 150.

The elastic gear 510*c* is formed in the shape of a ring, on the outer circumferential surface of which a plurality of gear teeth 511*c*, configured to be engaged with the gear teeth 213 of the stationary gear unit 200, is formed. The elastic gear 510*c* is provided at the center portion thereof with a rotary boss 517*c* for rotatably supporting the outer circumferential surface of the gear shaft 523*c*. The elastic gear 510*c* is provided on the inner circumferential surface thereof with a pair of opposing closed springs 513*c* spaced apart from the rotary boss 517*c* so as to contact the eccentric part 520*c* with a suitable elastic force.

The rotary boss 517*c* is supported in the center of the elastic gear 510*c* by a plurality of support ribs 519*c* extending from the lower part of the inner circumferential surface of the elastic gear 510*c*. The rotary boss 517*c* may be formed in the shape of a general boss. Preferably, however, the rotary boss 517*b* is formed in a shape including a plurality of protrusions to support the outer circumferential surface of the gear shaft 523*c* in a line contact state in order to minimize friction with the gear shaft 523*c* and wear of the rotary boss 517*c*. The support ribs 519*c* are spaced apart from the lower parts of the closed springs 513*c* by a suitable distance. Catching plates 52*c* of the eccentric part 520*c*, a description of which will follow, are inserted into spaces between the support ribs 519*c* and the closed springs 513*c* to prevent separation of the eccentric part 520*c*.

In some implementations, each closed spring 513*c* is formed in the shape of a leaf spring having a suitable length. One end and the other end of each closed spring 513*c* are integrally formed at the inner circumferential surface of the elastic gear 510*c*, and the middle part of each closed spring 513*b* is provided with a concave surface 515*c* provided adjacent to the rotary boss 517*c* and having a shape corresponding to the shape of the outer circumferential surface of the rotary boss 517*c*. Each closed spring 513*c* may be formed in a serpentine shape so as to form a suitable elastic force between the concave surface 515*c* of the closed spring 513*c* and the elastic gear 510*c*.

A catching protrusion 516*c* configured to contact a catching projection 525*c* of the eccentric part 520*c*, a description of which will follow, is formed at the middle part of the concave surface 515*c* of each closed spring 513*c* extending toward the rotary boss 517*c*. For example, when the auxiliary arm 150 cannot rotate, e.g., debris such as food particles disturbs the auxiliary arm 150 to rotate, resistance force from the auxiliary arm 150 causes a pressure to the eccentric rotation unit 500*c* through the link member 600. When particular pressure is applied to each closed spring 513*c*, the closed spring 513*c* is elastically deformed, whereby the catching projection 525*c* of the eccentric part 520*c* and the catching protrusion 516*c* may be separated from each other.

At least one pair of closed springs 513*c* may be provided at the inner circumferential surface of the elastic gear 510*c* so as to be opposite each other. The closed springs 513*c* may be located in a symmetrical fashion. In this example, two closed springs 513*c* are provided.

The eccentric part 520*c* includes a shaft 523*c* rotatably inserted into the shaft hole 135*c* of the gear shaft 523*c* formed in the spray arm 100, a rotary plate 521*c* formed at the upper part of the shaft 523*c*, an eccentric protrusion 527*c* spaced apart from the shaft 523*c* by a suitable distance to protrude from the rotary plate 521*c* at a position opposite the shaft 523*c* so as to be eccentric with respect to the shaft 523*c*, a catching plate 522*c* extending outward from the lower part of the rotary plate 521*c* so as to be supported by the lower part of each closed spring 513*c* when the catching plate 522*c* is inserted into the elastic gear 510*c*, and at least one catching projection 525*c* formed on the outer circumferential surface of the shaft 523*c* to come into contact with the catching protrusion 516*c* of each closed spring 513*b*, formed at the elastic gear 510*c*, when the eccentric part 520*c* rotates about the shaft hole 135*c*.

Preferably, a pair of catching projections 525*c* is formed in a symmetrical fashion so as to correspond to the closed springs 513*c*. In the case in which a pair of catching projections 525*c* is provided, therefore, the catching projections 525*c* are configured to contact catching protrusions 516*c* formed at a pair of closed springs 513*c*.

In addition, the catching plate 522*c* is formed to have a shape corresponding to the inner shape of each closed spring 513*b* formed at the elastic gear 510*c*, whereby the eccentric part 520*c* is separated from the elastic gear 510*c* only in the case in which the eccentric part 520*c* rotates to a specific angle when the elastic gear 510*c* is coupled to the elastic gear 510*c*.

In this example, the elastic gear 510*c* of the eccentric rotation unit 500*c*, which is engaged with the stationary gear unit 200, rotates together with the spray arm 100 when the spray arm 100 rotates, and, as the elastic gear 510*c* rotates, the catching projections 525*c* of the eccentric part 520*c* contact the catching protrusions 516*c* of the closed springs 513*c*, formed at the elastic gear 510*c*, with the result that the eccentric part 520*c* rotates simultaneously when the elastic gear 510*c* rotates.

The eccentric protrusion 527*c* of the eccentric part 520*c* is inserted into an insertion hole 625 of the link member 600, a description of which will follow, to convert rotational force into linear motion and to transfer the linear motion to the link member 600. The auxiliary arm 150 rotates by the link member 600 in a reciprocating fashion.

In some implementations, when the operation of the auxiliary arm 150 is restricted, the elastic gear 510*c* and the eccentric part 520*c* of the eccentric rotation unit 500*c* interrupt the transfer of the operating force from the stationary gear unit 200 to the link member 600 via the eccentric rotation unit 500*c* to prevent the rotational force of the stationary gear unit 200 from being transferred to the link member 600.

That is, if the rotational force generated by the rotation of the main arm 130 is transferred to the auxiliary arm 150 via the stationary gear unit 200 and the eccentric rotation unit 500*c* as operating force when the operation of the auxiliary arm 150 is restricted due to a specific reason, noise due to separation between the gear teeth 213 and 511*c* may be generated between the stationary gear unit 200 and the eccentric rotation unit 500*c*, through which power is transferred to the auxiliary arm 150, or the link member 600, which transfers the power to the auxiliary arm 150, may be damaged. When the operation of the auxiliary arm 150 is restricted, therefore, it is necessary to interrupt the transfer of operating force to the auxiliary arm 150.

If the power from the stationary gear unit 200, the eccentric rotation unit 500*c*, and the link member 600 is transferred to the auxiliary arm 150 when the rotation of the auxiliary arm 150 is restricted (for example, when foreign matter is inserted between the auxiliary arm connection member 170 and the auxiliary arm 150, with the result that the rotation of the auxiliary arm 150 is impossible), an excessive load may be applied to the stationary gear unit 200, the eccentric rotation unit 500*c*, and the link member 600, and noise may be generated, since the rotation of the auxiliary arm 150 is restricted.

In addition, if power is continuously transferred through the stationary gear unit 200, the eccentric rotation unit 500*c*, and the link member 600 in the state in which the rotation of the auxiliary arm 150 is restricted, the stationary gear unit 200, the eccentric rotation unit 500*c*, and the link member 600, which transfer power to the auxiliary arm 150, may be damaged.

In some implementations, when the operation of the auxiliary arm 150 is restricted, the motion of the link member 600, which transfers power to the auxiliary arm 150, is also restricted in response to the restriction of the operation of the auxiliary arm 150. In addition, the movement of the eccentric protrusion 527*c* of the eccentric part

520*c*, which is inserted into the insertion hole 625 of the link member 600 to reciprocate the link member 600, is also restricted as the movement of the link member 600 is restricted. As a result, the rotation of the eccentric part 520*c* is restricted.

The elastic gear 510*c* of the eccentric rotation unit 500*c*, which is engaged with the stationary gear unit 200 while rotating together with the main arm 130 when the main arm 130 rotates, rotates by the rotational force of the stationary gear unit 200. The catching protrusions 516*c* formed on the closed springs 513*b* of the elastic gear 510*b* may be separated from the catching projections 525*c* of the eccentric part 520*c*, whereby the elastic gear 510*c* may rotate.

That is, the catching protrusions 516*c* formed on the closed springs 513*c* of the elastic gear 510*c* of the eccentric rotation unit 500*c*, which receives rotational force from the stationary gear unit 200, are separated from the catching projections 525*c* of the eccentric part 520*c*, with the result that the elastic gear 510*c* may be continuously rotated despite the restriction of rotation of the eccentric part 520*c*.

In the case in which the rotation of the auxiliary arm 150 is restricted when the spray arm 100 rotates, therefore, the rotational force transferred from the stationary gear unit 200 to the eccentric rotation unit 500*c* by the rotation of the spray arm 100 (i.e. the main arm 130) is interrupted between the elastic gear 510*c* and the eccentric part 520*c* of the eccentric rotation unit 500*c*, thereby preventing the rotational force of the eccentric rotation unit 500*c* from being transferred to the link member 600.

In some implementations, the number of gear teeth 511*a*, 511*b*, or 511*c* formed at the elastic gear 510*a*, 510*b*, or 510*c* and the number of gear teeth 213 formed at the stationary gear unit 200 may be determined related to the rotation of the spray arm 100 and the auxiliary arm 150.

For example, where the number of gear teeth 213 formed at the stationary gear unit 200 and the number of gear teeth 511*a*, 511*b*, or 511*c* formed at the elastic gear 510*a*, 510*b*, or 510*c* have a multiple relationship, wash water sprayed through the auxiliary arm 150, which rotates by the power from the elastic gear 510*a*, 510*b*, or 510*c*, which is engaged with the stationary gear unit 200, may be sprayed to a constant position.

In this case, the wash water sprayed through the auxiliary arm 150 washes only a suitable region, with the result that the washing force of the auxiliary arm 150 may be reduced. That is, the rotational angle of the auxiliary arm 150 based on the rotational position of the main arm 130 is uniformly repeated, whereby the spray pattern of the wash water sprayed through the auxiliary arm 150 is repeated at a suitable position. If the spray pattern of the wash water sprayed through the auxiliary arm 150 is uniform, therefore, the sprayed range of the wash water is uniform, with the result that the washing force of the dishwasher 1 is reduced.

In some implementations, the number of gear teeth 213 formed at the stationary gear unit 200 and the number of gear teeth 511*a*, 511*b*, or 511*c* formed at the elastic gear 510*a*, 510*b*, or 510*c* can have a relative prime relationship. The sprayed position of wash water sprayed through the auxiliary arm 150 by the rotational force transferred by the stationary gear unit 200 and the elastic gear 510*a*, 510*b*, or 510*c* can be irregularly changed with respect to the rotational position of the auxiliary arm 150. Thus, the dishwasher can spray water in various spray patterns through the auxiliary arm 150.

Figure 14:
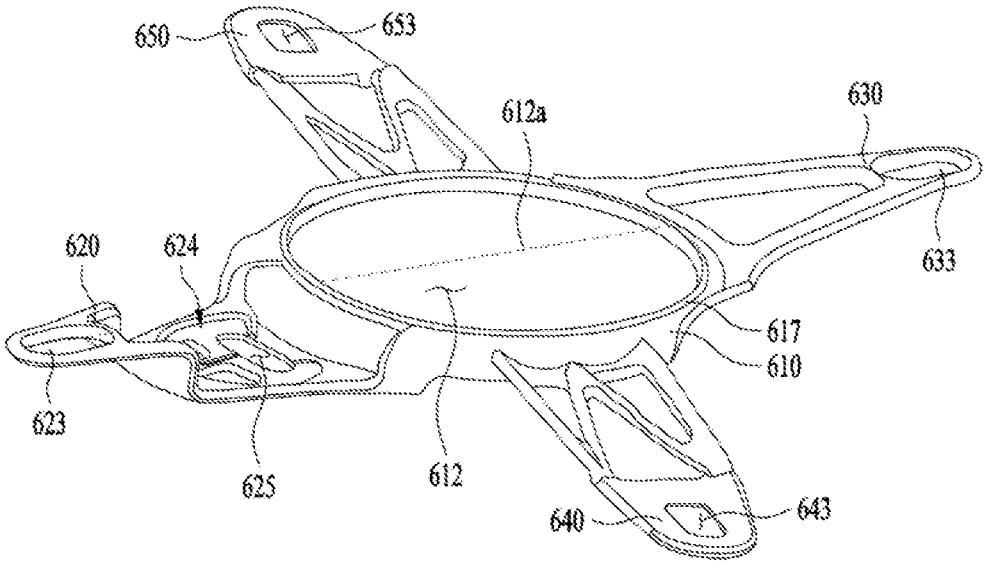
FIG. 14 is a diagram illustrating an example link member of a dishwasher.

FIG. 14 illustrates an example link member of a dishwasher.

As shown in FIG. 14, the link member 600 is connected to the power transmission parts 156 via the guide protrusions 136 (see FIG. 4). That is, the link member 600 may be connected to at least four positions of the main arm 130 and the auxiliary arms 150 of the spray arm 100.

The link member 600 may include a ring-shaped body 610, first extension parts 620 and 630 radially extending from the rim part 610 so as to be movably connected to the main arm 130, and second extension parts 640 and 650 connected to the auxiliary arms 150.

The rim part 610 may be provided in the center thereof with an insertion hole 612, into which the arm holder coupling part 180 is inserted. The insertion hole 612 may be larger than the diameter of the arm holder coupling part 180. The insertion hole 612 may be formed in an oval shape extending in the direction in which the link member 600 is reciprocated. Consequently, the link member 600 may be reciprocated about the arm holder coupling part 180 along the major axis 612 of the insertion hole 612.

The rim part 610 may further include a reinforcement rib 617 for increasing the strength of the rim part 610. The reinforcement rib 617 may be formed in the circumferential direction of the rim part 610, and may protrude upward.

The first extension parts 620 and 630 extend from the rim part 610 in opposite directions so as to be movably fastened to the main arm 130, and the second extension parts 640 and 650 extend from the rim part 610 in directions in which the second extension parts 640 and 650 intersect the first extension parts 620 and 630 so as to be movably fastened to the auxiliary arms 150.

Specifically, the first extension parts 620 and 630 may be provided with guide recesses 623 and 633, into which the guide protrusions 136 of the main arm 130 are inserted and fastened, and the second extension parts 640 and 650 may be provided with catching parts 643 and 653, into which the power transmission parts 156 of the auxiliary arms 150 are inserted and fastened. Consequently, the first extension parts 620 and 630 of the link member 600 may move along the guide protrusions 136 of the main arm 130, and the catching parts 643 and 653 of the second extension parts 640 and 650 of the link member 600 may move to the auxiliary arms 150 through the power transmission parts 156.

One of the first extension parts 620 and 630 may further include a recess 624 defining a space in which the eccentric rotation unit 500*a*, 500*b*, or 500*c* is mounted in order to avoid interference with the eccentric rotation unit 500*a*, 500*b*, or 500*c*. The recess 624 may be provided with an insertion hole 625, into which the eccentric protrusion 527*a*, 527*b*, or 527*c* of the eccentric rotation unit 500*a*, 500*b*, or 500*c* is inserted. The insertion hole 625 may be a slot, as shown.

The link member 600 transfers the power from the eccentric rotation unit 500*a*, 500*b*, or 500*c* to the power transmission parts 156, whereby the auxiliary arms 150 may roll along an arc track. That is, the reciprocation of the link member 600 is converted into rolling along an arc track of the auxiliary arms 150.

Hereinafter, the transfer of power to the stationary gear unit 200, the eccentric rotation unit 500*a*, 500*b*, or 500*c*, and the auxiliary arms 150 via the link member 600 will be described in detail with reference to the accompanying drawings. The following elements should be understood with reference to the above description and drawings.

Figure 15:
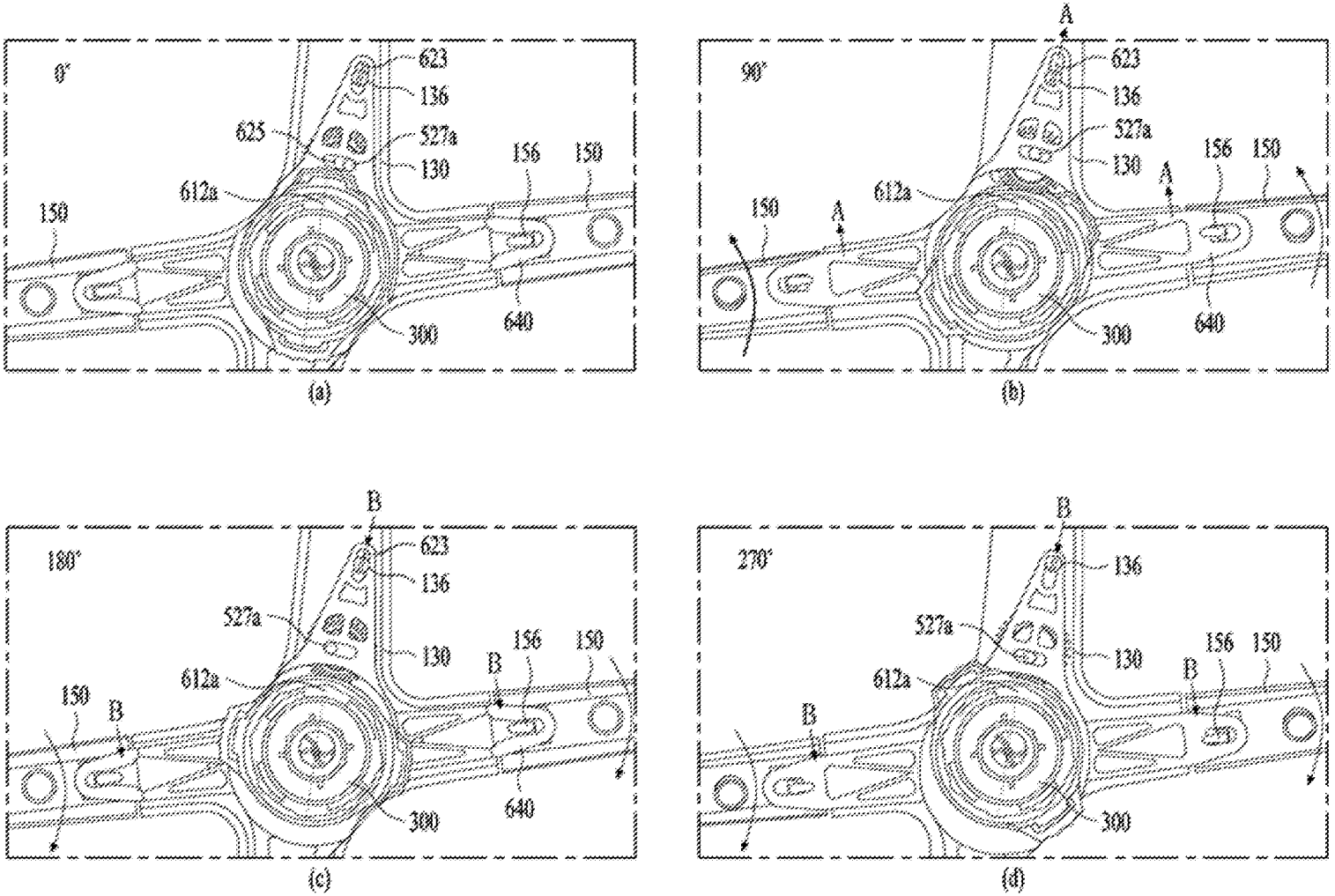
FIG. 15 is a diagram illustrating an example operation of auxiliary arms of a dishwasher.

FIG. 15 illustrates an example operation of auxiliary arms of a dishwasher.

The examples (a) to (d) in FIG. 15 show the lower surface of the spray arm assembly 10 when the eccentric rotation unit 500*a*, 500*b*, or 500*c* rotates by 0, 90, 180, and 270 degrees, respectively.

Referring to the example (a) in FIG. 15, the eccentric protrusion 527*a*, 527*b*, or 527*c* is located in one side of the insertion hole 625 in an initial state, in which the eccentric rotation unit 500*a*, 500*b*, or 500*c* is not rotated. Referring to the example (b) in FIG. 15, the link member 600 moves along the major axis 612*a* in a direction A when the eccentric rotation unit 500*a*, 500*b*, or 500*c* rotates 90 degrees in the counterclockwise direction.

That is, since the rim part 610 is formed in an oval shape, the rim part moves linearly toward the main arm 130 as the eccentric rotation unit 500*a*, 500*b*, or 500*c* rotates about the stationary gear unit 200. At this time, since the main arm 130 is spaced apart from the auxiliary arms 150 by a right or acute angle, the extension part 640 applies force to the power transmission part 156 in the direction in which the link member 600 moves as the link member 600 moves along the major axis 612*a*.

As a result, the auxiliary arm 150 moves along an arc track by a suitable angle upward in the figure. For example, the reciprocating angle of the auxiliary arm 150 may be about 40 degrees.

Referring to the example (c) in FIG. 15, the link member 600 moves along the major axis 612*a* in a direction B, which is opposite the direction A, when the eccentric rotation unit 500*a*, 500*b*, or 500*c* is further rotated 90 degrees in the counterclockwise direction. As a result, the link member 600 returns to the position shown in the example (a) in FIG. 15. At the same time, the auxiliary arm 150 is moved along an arc track in the opposite direction by the extension part 640, whereby the auxiliary arm 150 returns to the original position thereof.

Referring to the example (d) in FIG. 15, the link member 600 is moved along the major axis 612*a* in the direction B by the eccentric protrusion 527*a*, 527*b*, or 527*c* when the eccentric rotation unit 500*a*, 500*b*, or 500*c* is further rotated 90 degrees in the counterclockwise direction.

Since the rim part 610 is formed in an oval shape, the rim part moves linearly in the opposite direction as the eccentric rotation unit 500*a*, 500*b*, or 500*c* rotates about the stationary gear unit 200. At this time, the auxiliary arm 150 moves along the arc track by a suitable angle. The reciprocating angle of the auxiliary arm 150 may be about 40 degrees.

In other words, the rim part 610 of the link member 600 is linearly reciprocated toward the first spray ports 133 and the second spray ports 134 of the main arm 130, and the extension part 640 linearly reciprocates the power transmission part 156, whereby the auxiliary arm 150 is reciprocated along the arc track.

The reciprocation of the auxiliary arm 150 along the arc track may be regarded as rolling, which is one of rolling, yawing, and pitching, for describing vibration.

If debris such as food particles is inserted between the auxiliary arm 150 and the auxiliary arm connection member 170, to which the auxiliary arm 150 is coupled, the rotation of the auxiliary arm 150 is restricted. The transfer of operating force through the stationary gear unit 200 and the eccentric rotation unit 500*a*, 500*b*, or 500*c* is controlled by the elastic gear 510*a*, 510*b*, or 510*c* and the eccentric part 520*a*, 520*b*, or 520*c* of the eccentric rotation unit 500*a*, 500*b*, or 500*c*. Thus, rotation of the spray arm 100 can be maintained even when the rotation of the auxiliary arm 150 is restricted.

What is claimed is:

1. A dishwasher comprising:

a tub that includes an interior space;

a main arm that is coupled to the tub and that is configured to rotate about a first axis and spray water in the interior space;

an auxiliary arm that is coupled to the main arm and that is configured to rotate about a second axis and spray water in the interior space;

a first gear unit that is coupled to the tub, that is configured to rotatably support the main arm, and that includes a plurality of gear teeth;

an second gear unit that is coupled to the main arm, that is engaged with one or more teeth of the plurality of gear teeth of the first gear unit, and that is configured to, (i) based on rotation of the main arm, rotate to transfer rotational force to the auxiliary arm and, (ii) based on receiving resistance force from the auxiliary arm, buffer transfer of resistance force from the auxiliary arm to the first gear unit; and a link member that is supported by the main arm, that couples the second gear unit to the auxiliary arm, and that is configured to rotate the auxiliary arm based on rotational force of the first gear unit that is transferred through the second gear unit, wherein the second gear unit includes:

an eccentric part that is coupled to the auxiliary arm through the link member, and based on receiving resistance force from the auxiliary arm, an elastic gear that is configured to buffer transfer of resistance force from the auxiliary arm to the eccentric part.

2. The dishwasher of claim 1, wherein the eccentric part is separated from the elastic gear based on resistance force from the auxiliary arm.

3. The dishwasher of claim 1, wherein the eccentric part includes:

a rotary plate that is supported by the elastic gear, a shaft that extends from the rotary plate, the elastic gear being configured to rotate about the shaft, an eccentric protrusion that protrudes from the rotary plate and that is coupled to the link member to transfer rotational force generated during rotation of the second gear unit to the auxiliary arm through the link member, and a catching projection (i) that protrudes from the rotary plate, (ii) that is coupled to the elastic gear based on resistance force from the auxiliary arm, and (iii) that is configured to receive rotational force generated during rotation of the second gear unit through the elastic gear, and wherein the elastic gear includes:

a rotary boss that is coupled to the main arm and supports the shaft, and an elastic part that is located on an inner surface of the elastic gear and that is coupled to the catching projection based on resistance force from the auxiliary arm.

4. The dishwasher of claim 3, wherein the elastic part includes:

a plate-shaped leaf spring that extends from the inner surface of the elastic gear and that is coupled to the catching projection based on resistance force from the auxiliary arm.

5. The dishwasher of claim 4, wherein the plate-shaped leaf spring includes at least one elastic portion that has a serpentine shape.

6. The dishwasher of claim 3, wherein the elastic part includes:

a leaf spring that includes (i) a first end and a second end, the first end and the second end being coupled to the inner surface of the elastic gear and (ii) a convex portion that is located between the first end and the second end and that is coupled to the catching projection based on resistance force from the auxiliary arm.

7. The dishwasher of claim 6, wherein the leaf spring further includes a concave portion that is not in contact with the catching projection.

8. The dishwasher of claim 6, wherein the leaf spring includes at least one elastic portion that has a serpentine shape.

9. The dishwasher of claim 3, wherein the elastic part includes:

at least one pair of elastic portions that are located on the inner surface of the elastic gear and that are arranged to face each other, and a support rib (i) that supports the rotary boss and (ii) that extends from a portion of the inner surface of the elastic gear, the portion of the inner surface of the elastic gear being located between the elastic portions.

10. The dishwasher of claim 9, wherein the rotary plate is located among the support rib and the elastic portions.

11. The dishwasher of claim 1, wherein the link member includes:

a ring-shaped body, a first extension part that couples the ring-shaped body to the main arm and that extends in a first direction in which the main arm extends, and a second extension part that couples the ring-shaped body to the auxiliary arm and that extends in a second direction in which the auxiliary arm extends.

12. The dishwasher of claim 11, wherein the main arm includes a guide protrusion, and wherein the first extension part includes a guide recess (i) into which the guide protrusion is inserted and (ii) that is configured to guide the link member.

13. The dishwasher of claim 12, wherein the link member is configured to move in the first direction along the guide protrusion.

14. The dishwasher of claim 11, wherein the second gear unit includes an eccentric protrusion, and wherein the first extension part includes an insertion hole (i) into which the eccentric protrusion is inserted and (ii) that is configured to guide the link member.

15. The dishwasher of claim 14, wherein the link member is configured to move linearly between a first position and a second position in the first direction.

16. The dishwasher of claim 1, wherein the link member is configured to, based on rotation of the second gear unit, move linearly between a first position and a second position, and wherein the auxiliary arm is configured to rotate based on linear movement of the link member.

17. The dishwasher of claim 1, wherein the main arm includes:

a first spray port that is located at a first portion of the main arm and that is configured to spray water in one direction, and a second spray port that is located at a second portion of the main arm and that is configured to spray water in another direction.

18. The dishwasher of claim 1, wherein the auxiliary arm is configured to spray water to a first position in the interior space while the auxiliary arm rotates.

19. The dishwasher of claim 1, wherein a direction of water that is sprayed from the auxiliary arm is determined based on a gear ratio between the first gear unit and the second gear unit.

* * * * *